United States Patent [19]

Nanjo et al.

[11] Patent Number: 4,520,778

[45] Date of Patent: Jun. 4, 1985

[54] METHOD OF CONTROLLING ENGINE SPEED FOR INTERNAL COMBUSTION ENGINE

[75] Inventors: Hirotoshi Nanjo, Mishima; Hiroo Satou, Susono; Osamu Takahashi, Numazu, all of Japan

[73] Assignee: Kokusan Denki Co., Ltd., Numazu, Japan

[21] Appl. No.: 540,368

[22] Filed: Oct. 11, 1983

[51] Int. Cl.[3] ..... F02D 11/10

[52] U.S. Cl. ..... 123/352; 180/179

[58] Field of Search ..... 123/339, 352; 180/176, 180/179

[56] References Cited

U.S. PATENT DOCUMENTS

| | | | |
|---|---|---|---|
| 3,533,236 | 10/1970 | Cottington | 123/352 X |
| 3,869,019 | 3/1975 | Cardani | 123/352 X |
| 4,094,378 | 6/1978 | Scheyhing et al. | 123/352 X |
| 4,169,437 | 10/1979 | Fleisher | 123/352 X |
| 4,370,960 | 2/1983 | Otsuka | 123/339 |
| 4,374,422 | 2/1983 | O'Keefe, Jr. et al. | 123/352 X |
| 4,425,888 | 1/1984 | Engel et al. | 123/352 X |

*Primary Examiner*—Tony M. Argenbright

*Attorney, Agent, or Firm*—Pearne, Gordon, Sessions, McCoy, Granger & Tilberry

[57] ABSTRACT

A method of controlling an engine speed for an internal combustion engine and an apparatus therefor which are capable of significantly improving transient response characteristics and controlling the engine speed with high accuracy. The method and apparatus are adapted to keep the actual engine speed at a set engine speed by proportional control action and derivative control action wherein a derivative control engine speed range is set about the set engine speed to stop derivative action to allow only proportional action to operate an engine speed adjusting operation unit when the actual engine speed is out of the range.

10 Claims, 14 Drawing Figures

METHOD OF CONTROLLING ENGINE SPEED FOR INTERNAL COMBUSTION ENGINE

BACKGROUND OF THE INVENTION

1. Field of the Invention

This invention relates to a method of controlling an engine speed for an internal combustion engine and an apparatus therefor, and more particularly to a method for controlling the speed or number of revolutions of an internal combustion engine to a predetermined or set level or engine speed and an apparatus therefor.

2. Description of the Prior Art

A control system of such type which has been conventionally known and practiced in the art is generally adapted to allow proportional control action to operate an engine speed adjusting operation unit in view of deviation of the actual engine speed of an engine from a predetermined or set engine speed thereof and allow derivative control action to operate the operation unit dependent upon the rate of change of the actual engine speed with respect to time, to thereby keep the actual engine speed at the set value. The term "operation unit" used herein indicates, for example, a throttle valve in a gasoline engine or an injection adjusting means of a fuel injection pump in a diesel engine. In such conventional control system, when the engine speed changes in the direction away from the set value, the proportional action and derivative action act together to return the engine speed to the set value; however, once the engine speed begins to change in the direction toward the set value, only the proportional action takes place to return the engine speed to the set value and the derivative action acts to restrain the engine speed from approaching the set value. In view of the foregoing, the conventional system is constructed to carry out the derivative action over the whole range of change of the engine speed, thus, it has an important disadvantage that it takes too much time to return the actual engine speed to the set value to cause transient response characteristics to be substantially deteriorated, when a load of the engine varies and/or the set value is changed.

BRIEF DESCRIPTION OF THE INVENTION

The present invention has been made in view of the foregoing disadvantage of the prior art.

Accordingly, it is an object of the present invention to provide a method of controlling an engine speed for an internal combustion engine which is capable of greatly improving transient response characteristics.

It is another object of the present invention to provide an apparatus for controlling an engine speed for an internal combustion engine which is capable of greatly improving transient response characteristics.

It is a further object of the present invention to provide an apparatus for controlling an engine speed for an internal combustion engine which is capable of controlling the engine speed with great accuracy.

In accordance with the present invention, there is provided a method of controlling an engine speed for an internal combustion engine which is adapted to carry out proportional control action which operates an engine speed adjusting operation unit of said engine depending upon deviation of the actual engine speed of said engine from a set engine speed thereof and derivative control action which operates said operation unit depending upon the rate of change of said actual engine speed with respect to time, to thereby keep the actual engine speed at the set engine speed, comprising the step of setting a derivative control engine speed range for carrying out said derivative control action about said set engine speed, to thereby stop said derivative control action to allow only said proportional control action to operate said operation unit when said actual engine speed of said engine is out of said derivative control engine speed range.

In accordance with the present invention, there is also provided an apparatus for controlling an engine speed for an internal combustion engine which controls to keep the engine speed of the internal combustion engine at a set engine speed based on proportional control action and derivative control action comprising an engine speed detecting circuit for detecting the actual engine speed of the engine, said engine speed detecting circuit comprising a reference signal generating circuit which generates a reference rectangular wave signal $P_0$ of a constant signal width $\theta_0$ for detecting the engine speed at a fixed rotation angle position of said engine and an engine speed detection pulse generating circuit for generating first engine speed detection pulse $P_1$ having a first pulse width $\theta_1$ which is narrower than the signal width $\theta_0$ of said reference rectangular wave signal $P_0$ and changes depending upon the change of said actual engine speed and second engine speed detection pulse $P_2$ having a second pulse width $\theta_2$ which is equal to the difference between said signal width $\theta_0$ of said reference rectangular wave signal $P_0$ and said first pulse width $\theta_1$; a deviation signal generating circuit for generating an engine speed deviation signal indicating deviation of said actual engine speed from said set engine speed, said deviation signal generating circuit comprising a circuit which takes the difference between a first engine speed data signal $n_1$ obtained by converting the time width $T_1$ of said first engine speed detection pulse $P_1$ into a digital quantity and a second engine speed data signal $n_2$ obtained by converting the time width $T_2$ of said second engine speed detection pulse $P_2$ into a digital quantity; a derivative signal generating circuit for generating an engine speed derivative signal indicating the rate of change of said deviation or actual engine speed with respect to time, said derivative signal generating circuit comprising a memory circuit which stores therein, as an engine speed detecting signal n, a differential signal between said first engine speed data signal $n_1$ and said second engine speed data signal $n_2$ or a digital signal obtained by converting the time width of said first engine speed detection pulse $P_1$ into a digital quantity and a variation detecting circuit which takes the difference between an engine speed detecting signal n' previously stored in said memory circuit and a newly generated engine speed detecting signal n; a first manipulated variable command signal generating circuit for generating a first manipulated variable command signal which determines manipulated variable of an engine speed adjusting operation unit within said internal combustion engine depending upon said engine speed deviation signal; a second manipulated variable command signal generating circuit for generating a second manipulated variable command signal which determines manipulated variable of said operation unit depending upon said engine speed derivative signal; an operation signal generating circuit for generating an operation signal necessary to operate said operation unit based on said first and second manipulated variable command signals; and a derivative action stopping control circuit which acts to set a derivative control engine speed range about said set engine speed and render said second manipulated variable command signal generated from said second manipulated variable command signal generating circuit zero when said actual engine speed is out of said derivative control engine speed range, said derivative action stopping control circuit acting to set, as said derivative control engine speed range, a range between an engine speed at which said first pulse width $\theta_1$ of said first engine speed detection pulse $P_1$ is rendered zero and an engine speed at which the second pulse width $\theta_2$ of said second engine speed detection pulse $P_2$ is rendered zero.

BRIEF DESCRIPTION OF THE DRAWINGS

Other objects and many of the attendant advantages of the present invention will be readily appreciated as the same becomes better understood by reference to the following detailed description when considered in connection with the accompanying drawings, in which like reference numerals designate the same parts throughout the figures thereof and wherein.

DETAILED DESCRIPTION OF THE PREFERRED EMBODIMENTS

Now, a method and an apparatus for controlling an engine speed for an internal combustion engine will be described hereinafter with reference to the accompanying drawings.

Figure 1:
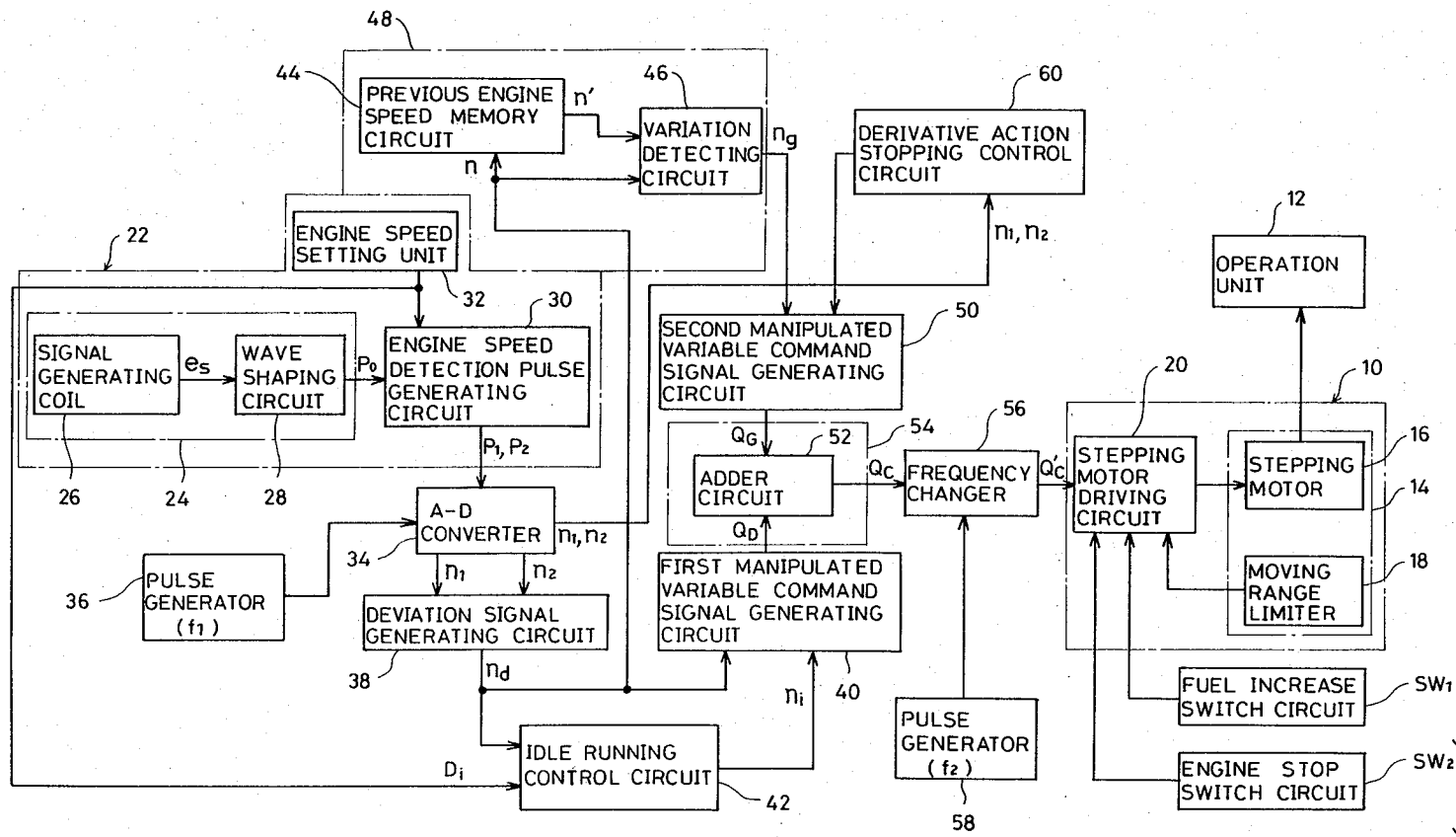
FIG. 1 is a block diagram illustrating one embodiment of the present invention.

In FIG. 1 illustrating an embodiment of an apparatus for practicing a method of the present invention, reference numeral 10 designates a control element for operating an engine speed adjusting operation unit 12 or an operation unit for adjusting the engine speed or the number of revolutions of an internal combustion engine. The control element 10 comprises an actuator 14 including a stepping motor 14 which generates driving force for operating the operation unit 12 and a moving range limiter 18 which determines the moving range of the operation unit 12, and a stepping motor driving circuit 20 for driving the stepping motor 16. The driving force generated from the stepping motor 16 is transmitted from the output end of the actuator 14 through a suitable transmission mechanism to the operation unit 12 to operate the operation unit 12. The stepping motor driving circuit 20 is supplied thereto step number command signals $Q_C'$ equal in number to the predetermined number of steps from a control circuit described hereinafter, the command signals $Q_C'$ each comprising pulses having a predetermined frequency. The stepping motor 16 rotates at an angle proportional to the number of pulses of the command signal, so that the operation unit 12 is operated in amount proportional to the rotation angle of the motor 16. The moving range limiter 18, when the output end of the actuator 14 (the output shaft of the stepping motor 16) moves to a limit position, acts to detect the displacement to supply to the stepping motor driving circuit 20 a stop command signal for stopping the stepping motor 16 and an inversion command signal for inverting the rotational direction of the stepping motor. The stepping motor driving circuit 20 is also supplied thereto signals from a fuel increase switch circuit $SW_1$ and an engine stop switch circuit $SW_2$. The driving circuit 20 acts to drive the stepping motor 16 in the direction of increasing the supply of a fuel to the engine when a switch in the fuel increase switch circuit $SW_1$ is closed, and drive the stepping motor in the direction of interrupting the supply of a fuel to the engine when a switch in the engine stop switch circuit $SW_2$ is closed. The engine speed adjusting operation unit 12 corresponds to, for example, a throttle valve in a gasoline engine or an injection adjusting means of a fuel injection pump in a diesel engine.

In order to detect the engine speed or the number of revolutions of the engine, the apparatus of the embodiment illustrated further includes an engine speed detecting circuit 22. The detecting circuit 22 includes a reference signal generating circuit 24 which comprises a signal generating coil 26 and a wave shaping circuit 28. The signal generating coil 26 is attached to an output shaft of the engine, a cam shaft thereof or the like so as to be arranged in a signal generator adapted to rotate in synchronism with rotation of the engine, to thereby generate an output signal $e_s$ having a half cycle of a constant or reference angular width at a predetermined or reference rotational angle position during one rotation of the output shaft or cam shaft of the engine. The wave shaping circuit 28 is adapted to shape a half wave or half cycle of the output signal $e_s$ generated from the signal generating coil 26 to generate a reference signal $P_0$ of a rectangular wave having a constant or reference signal width $\theta_0$ for detecting the engine speed. The rectangular wave signal $P_0$ is generated at a predetermined rotational angle position $\alpha_0$ during one rotation of the output shaft or cam shaft of the engine. The time width $T_0$ of the rectangular wave signal $P_0$ varies inversely proportional to the engine speed, because it has a constant signal width (angular width). Thus, it should be noted the time width $T_0$ of the rectangular wave signal $P_0$ contains data on the engine speed. The engine speed detecting circuit 22 also includes an engine speed detection pulse generating circuit 30 for generating a pulse corresponding to an engine speed detected and an engine speed setting unit 32 for supplying a set engine speed to the engine speed detection pulse generating circuit 30. The engine speed detection pulse generating circuit 30 acts to receive the reference rectangular wave signal $P_0$ to generate first engine speed detection pulses $P_1$ each having a pulse width (angular width) $\theta_1$ narrower than the signal width $\theta_0$ of the rectangular wave signal $P_0$ and second engine speed detection pulses $P_2$ each having a second pulse width $\theta_2$ equal to the difference between the signal width $\theta_0$ and the first pulse width $\theta_1$. The first and second engine speed detection pulses $P_1$ and $P_2$ have a relationship $\theta_1+\theta_2=\theta_0$ therebetween. The pulse widths $\theta_1$ and $\theta_2$ are signals varying in the directions opposite to each other with the change of engine speed or in a manner such that one becomes larger when the other becomes smaller, and become equal to each other when the actual engine speed reaches the set engine speed.

The above-mentioned first and second engine speed detection pulses $P_1$ and $P_2$ are supplied to an Analog-Digital converter (A-D converter) 34. The A-D converter 34 acts to convert the time width $T_1$ of the first engine speed detection pulse $P_1$ to a digital quantity to generate a first engine speed data signal $n_1$ and convert the time width $T_2$ of the second engine speed detection pulse $P_2$ into a digital quantity to generate a second engine speed data signal $n_2$. Such conversion is carried out, for example, by supplying clock pulses of a frequency $f_1$ supplied from a pulse generator 36 through a gate circuit opened by the first and second engine speed detection pulses $P_1$ and $P_2$ to a counter to count the number of clock pulses supplied thereto while the first and second engine speed detection pulses are generated.

The first and second engine speed data signals $n_1$ and $n_2$, which are given or determined by the number of pulses counted by the counter, are supplied to a deviation signal generating circuit 38. The deviation signal generating circuit 38 acts to take the difference $(n_1-n_2)$ between the data signals $n_1$ and $n_2$ to generate a deviation signal $n_d$ given by the number of counted pulses. The deviation signal $n_d$ is supplied to a first manipulated variable command signal generating circuit 40, where the deviation signal $n_d$ is multiplied by a certain factor to be converted into a first manipulated variable command signal $Q_D$ acting to determine a manipulated variable (the number of steps of the stepping motor) of the engine speed adjusting operation unit 12. The difference between the first and second engine speed data signals $n_1$ and $n_2$ indicates deviation of the actual engine speed from the set engine speed, which will be hereinafter described in detail.

The deviation signal $n_d$ is supplied to an idle running control circuit 42 together with an idling speed command signal $D_i$ fed from the engine speed setting unit 32. The idle running control circuit 42 generates a deviation signal $n_i$ (given by the number of pulses) indicating deviation of the actual engine speed from the idling speed when the command signal $D_i$ is supplied thereto. When the deviation signal $n_i$ is supplied to the first manipulated variable command signal generating circuit 40, the circuit 40 generates a manipulated variable command signal $Q_D$ which determines a manipulated variable of the operation unit 12 necessary to carry out idle running of the engine.

The deviation signal $n_d$ is supplied to a memory circuit 44 for storing a previous engine speed and a variation detecting circuit 46 as an engine detecting signal n. The variation detecting circuit 46 comprises a subtractor circuit and acts to take the difference between a previous engine speed detecting signal n' stored in the memory circuit 44 and a newly generated engine speed detecting signal n to generate an engine speed derivative signal $n_g$. In the embodiment illustrated, the memory circuit 44 and the variation detecting circuit 46 form together a derivative signal generating circuit 48. The derivative signal $n_g$ is received by a second manipulated variable command signal generating circuit 50, where the signal $n_g$ is multiplied by a certain factor to be converted into a second manipulated variable command signal $Q_G$ which commands manipulated variable of the operation unit 12 (the number of steps of the stepping motor). The first manipulated variable command signal $Q_D$ and second manipulated variable command signal $Q_G$ are supplied to an adder circuit 52 to be added to each other, so that an operation signal $Q_C$ may be obtained at the output side of the adder circuit 52 which indicates manipulated variable of the operation unit 12 (the number of steps). In the present embodiment, the adder circuit 52 constitutes an operation signal generating circuit 54. The operation signal $Q_C$ is supplied to a frequency changer 56 together with the output of a pulse generator 58 which generates pulses of a frequency $f_2$. The frequency changer 56 generates the step number command signal or driving pulse signal $Q_C'$ of a frequency $f_2$ having pulses of the number corresponding to the number of steps necessary to operate the operation unit 12 to a level of manipulated variable corresponding to the operation signal $Q_C$. The step number command signal $Q_C'$ is supplied to the stepping motor driving circuit 20, so that the stepping motor 16 rotates one step every supplying of each pulse of the step number command signal to operate the operation unit 12.

The first and second engine speed data signals $n_1$ and $n_2$ obtained from the A-D converter 34 are also supplied to a control circuit for stopping derivative control action designated by reference numeral 60. The control circuit 60 serves to determine a range between the engine speed at the time when the first engine speed data signal $n_1$ becomes zero and the engine speed at the time when the second engine speed data signal $n_2$ becomes zero as a derivation control engine speed range or a range of engine speed in which derivative control takes place. The control circuit 60 also acts to render the second manipulated variable command signal $Q_G$ zero to allow the derivative action to be stopped when an engine speed is out of this range. In this regard, in the embodiment illustrated, the control circuit 60 controls the second manipulated variable command signal generating circuit 50 to render the second manipulated variable command signal zero. However, the present embodiment may be constructed in such a manner that the control circuit 60 controls the derivative signal generating circuit 48 to render the derivative signal zero, to thereby cause the second manipulated variable command signal $Q_G$ to be zero.

Figure 2:
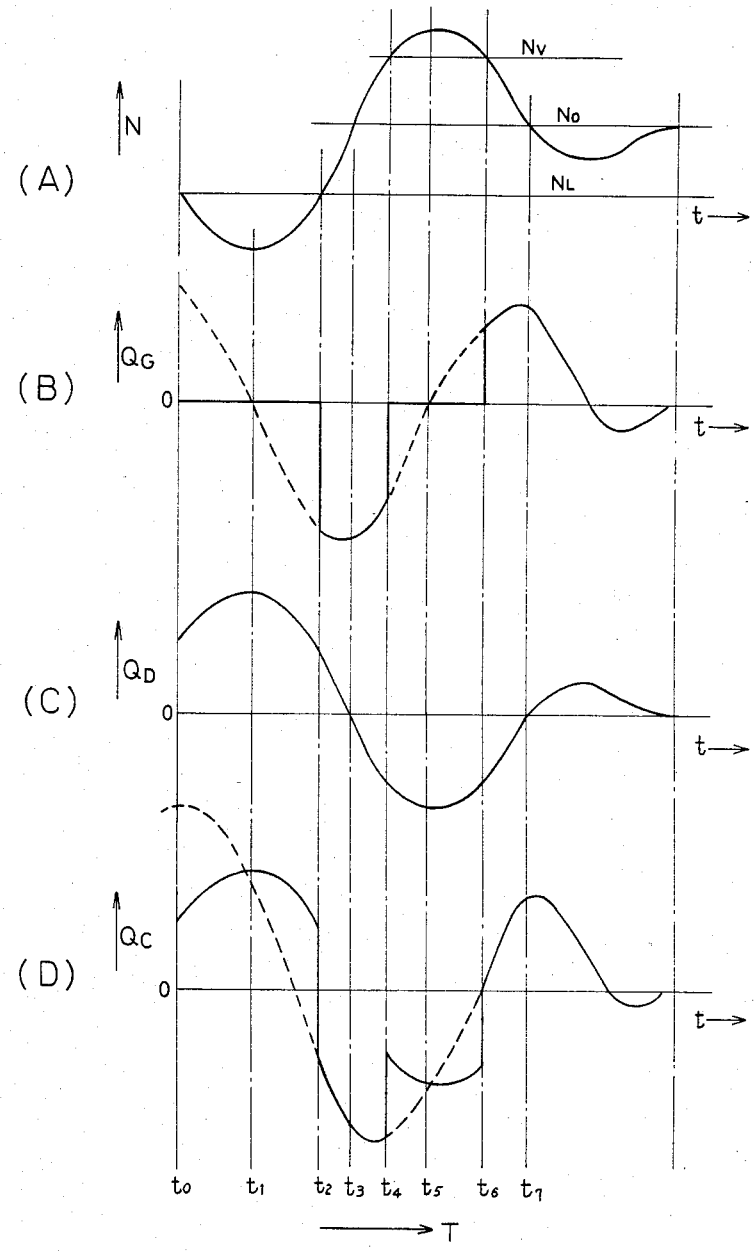
FIGS. 2A to 2D are diagrammatic views for explaining the control operation of the present invention.

In the control apparatus of the embodiment shown in FIG. 1, let it be supposed that the load of engine is varied to cause the actual engine speed N to change with respect to time t as shown in FIG. 2A. In FIG. 2A, the set engine speed is designated by $N_0$, and $N_L$ and $N_V$ respectively indicate an upper limit engine speed and a lower limit engine speed in the derivative control engine speed range. When the change of engine speed as shown in FIG. 2A occurs, the first manipulated variable command signal generating circuit 40 generates the first manipulated variable command signal $Q_D$ as shown in FIG. 2C depending upon the deviation signal $n_d$, and the second manipulated variable command signal generating circuit 50 generates the second manipulated variable command signal $Q_G$ as indicated in solid lines in FIG. 2B depending upon the derivative signal $n_g$. These command signals are added to each other in the adder circuit 52 to allow the operation signal $Q_C$ as indicated in solid lines in FIG. 2D to be generated from the adder circuit 52. The operation signal $Q_C$ is converted into the step number command signal or driving pulse signal $Q_C'$, so that pulses of a predetermined number are supplied to the stepping motor 16. The stepping motor 16 rotates in amount of steps of the number corresponding to the number of operation signals $Q_C$ to operate the operation unit 12, to thereby cause the actual engine speed to reach or approach the set engine speed $N_0$. In this instance, the first manipulated variable command signal $Q_D$ acts to allow the actual engine speed to coincide with the set engine speed by proportional control action which operates the operation unit 12 depending upon the deviation signal $n_d$, and the second manipulated variable command signal $Q_G$ acts to restrain the change of engine speed by derivative control action which operates the operation unit 12 depending upon the rate of change of the engine speed with respect to time.

The present embodiment, as described hereinbefore, is adapted to carry out the derivative control action only in the specific derivative control engine speed range or the range in which the derivative action is to take place, thus, it is possible to significantly shorten time required for the actual engine speed to reach the set value. This allows transient response characteristics or response to the change of engine speed due to the change of load, the change of engine speed, the change of engine torque or the like to be substantially improved.

The parts shown in dotted lines in FIGS. 2B and 2D indicate the second manipulated variable command signal $Q_G$ generated in a range out of the derivative control engine speed range when the derivative action stopping control circuit 60 is not provided. When the derivative action stopping control circuit 60 is not provided, the second manipulated variable command signal $Q_G$ acts as a speed increasing signal which serves to prevent decreasing of the engine speed and increase the engine speed, for a period of time between $t_1$ and $t_2$ during which the engine speed is decreasing. At this time, the first manipulated variable command signal $Q_D$ also acts as a speed increasing signal and serves to coincide the actual engine speed with the set value. This results in the operation signal $Q_C$ $(=Q_G+Q_D)$ significantly increasing, so that a number of pulses are supplied to the stepping motor 16 to allow the operation unit 12 to be operated in the direction of increasing the engine speed. When surplus torque generates in the engine at time of $t_1$ to cause the engine speed to begin to increase, the second manipulated variable command signal $Q_G$ acts as a speed decreasing signal serving to prevent increasing of the engine speed and decrease the engine speed. Therefore, the second manipulated variable command signal $Q_G$ acts to prevent the increasing action by the first operation signal $Q_D$. When the actual engine speed exceeds the set engine speed $N_0$ due to surplus torque generating at the time $t_1$, the second manipulated variable command signal $Q_G$ acting as a speed decreasing signal restrains the engine speed from increasing. At this time, the first manipulated variable command signal $Q_D$ also acts as a speed decreasing signal to cause the actual engine speed to coincide with the set engine speed. When the engine speed begins to decrease at time of $t_5$, the second manipulated variable command signal $Q_G$ acts as a speed increasing signal to restrain decreasing of the engine speed, to thereby prevent the first manipulated variable command signal $Q_D$ from carrying out the speed decreasing operation. Such actions as described above are subsequently repeated to allow the actual engine speed to gradually coincide with the set engine speed $N_0$. As can be seen from the foregoing, if the derivative control engine speed range is not determined, the proportional control action which acts to cause the actual engine speed to coincide with the set engine speed based on the derivative control action is restrained, resulting in a long period of time being required to cause the actual engine speed to coincide with the set value. This obliges the transient response characteristics or the response to the change of engine speed due to the change of load, the change of set engine speed, the change of engine torque or the like to be deteriorated.

On the contrary, in the case of determining a derivative control engine speed range to carry out derivative action only in the range as in the illustrated embodiment of the present invention, the derivative action is stopped when an engine speed is out of such range; thus, it is possible to return the actual engine speed to a level near the set engine speed (engine speed within the derivative control engine speed range) in a short period of time. Also, when the engine speed enters the derivative control engine speed range, the derivative action is carried out to allow the actual engine speed to coincide with the set value while restraining the change of engine speed from overshooting. Thus, it will be readily noted that the present embodiment is capable of substantially shortening the time required to cause the actual engine speed to coincide with the set value utilizing the proportional action and the derivative action, to thereby significantly improve the transient response characteristics.

In the embodiment described above, the deviation signal $n_d$ is supplied as the engine speed detecting signal n to the memory circuit 44 and the variation detecting circuit 46. The change of deviation signal $n_d$ indicates the absolute change in actual engine speed because the deviation signal $n_d$ indicates a magnitude of the actual engine speed relative to the set engine speed. Thus, differential of the deviation signal $n_d$ by time is equivalent to that of the actual engine speed by time. Accordingly, the derivative signal $n_g$ can be obtained by differential of the actual engine speed by time instead of differential of the deviation signal $n_d$ by time as well.

Figure 3:
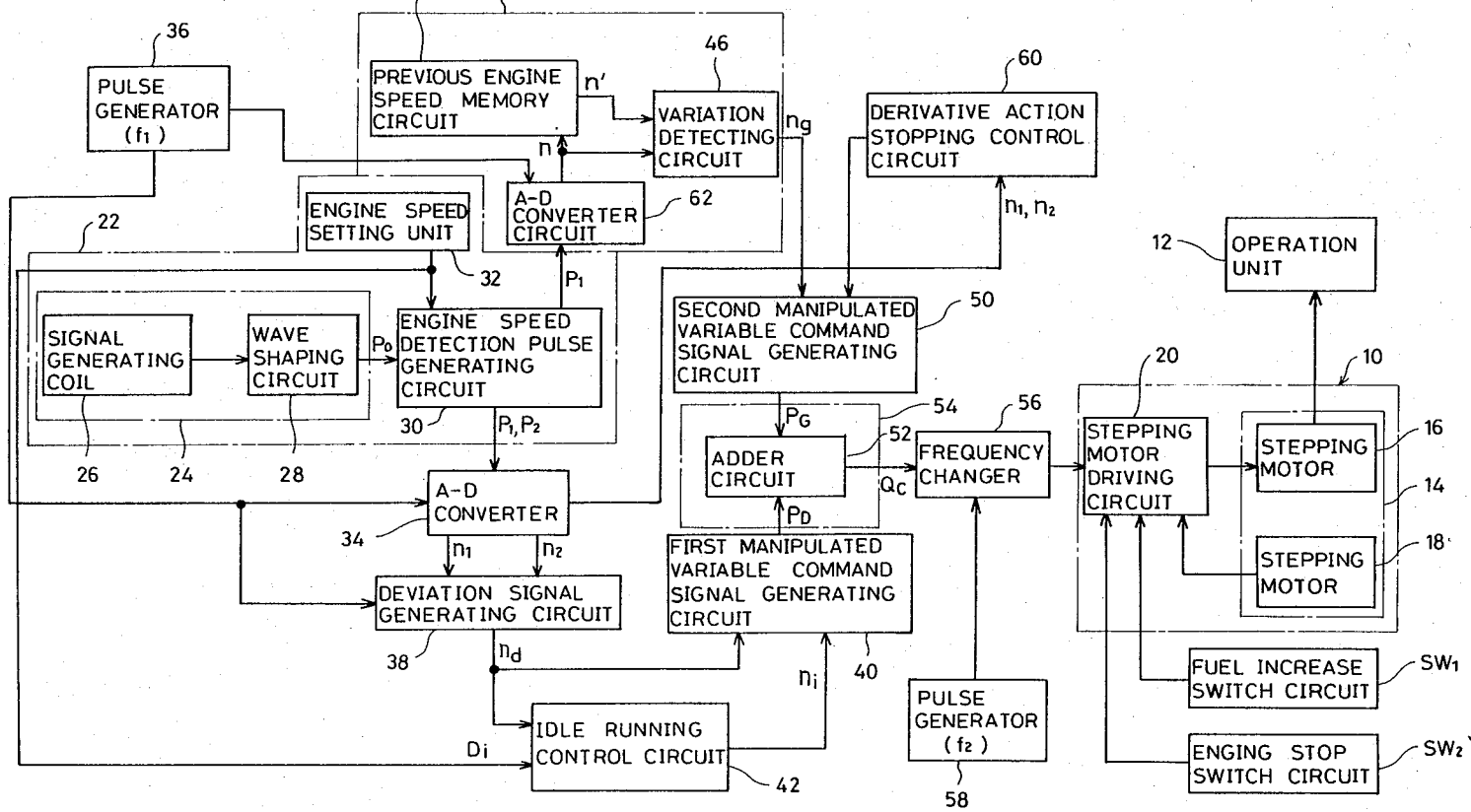
FIG. 3 is a block diagram illustrating another embodiment of the present invention.

FIG. 3 illustrates another embodiment of a control apparatus according to the present invention which is adapted to carry out such differential of the actual engine speed by time to obtain a derivative signal $n_g$. For this purpose, the embodiment of FIG. 3 includes an Analog-Digital converter circuit (A-D digital converter) 62 which acts to convert the time width of a first engine speed detection pulse $P_1$ containing a data on the actual engine speed into an engine speed detecting signal n. In the present embodiment, the engine speed detecting signal n is equivalent with a first engine speed data signal $n_1$; therefore, the embodiment may be constructed in a manner such that the first engine speed data signal $n_1$ is supplied as the engine speed detecting signal n (given by the number of counted pulses) to a memory circit 44 and a variation detecting circuit 46. Also, a reference rectangular wave signal $P_0$ may be used as the engine speed detecting signal n by converting the time width of the signal $P_0$ into a digital quantity.

In each of the embodiments described above, the first and second engine speed detection pulses $P_1$ and $P_2$ respectively having pulse widths $\theta_1$ and $\theta_2$ are made from the reference rectangular wave signal $P_0$ having a constant signal width $\theta$, and the pulse width $\theta_1$ and $\theta_2$ are adapted to change in the directions opposite to each other with the change of engine speed while keeping the relationship $\theta_1+\theta_2=\theta_0$. Accordingly, when the difference in time width between the first and second engine speed detection pulses $P_1$ and $P_2$ is obtained, it is possible to significantly improve discrimination in digitization of the engine speed detecting signal to detect the engine speed with high accuracy, because the change of engine speed may be enlargedly detected. The term "discrimination" used herein means conversion accuracy in the case of converting the time width of a signal into the number of clock pulses using clock pulses having a constant frequency, and the discrimination may be indicated by the number of clock pulses which are allocated every unit time. Further, the difference in time width between the first and second engine speed detection pulses $P_1$ and $P_2$ also allows deviation of the actual engine speed from the set engine speed to be enlargedly detected, which will be described hereinafter with reference to FIG. 4.

Figure 4:
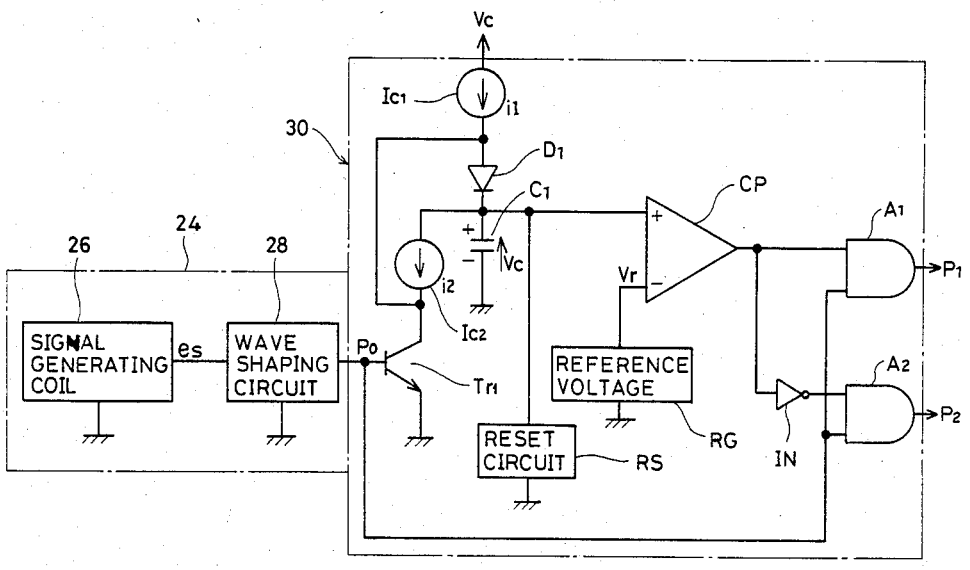
FIG. 4 is a wiring diagram showing an example of an engine speed detecting circuit.

FIG. 4 shows an example of the engine speed detecting circuit 22, which includes a capacitor $C_1$ connected through a diode $D_1$ and a constant current circuit $I_{C1}$ to a power supply of a voltage $V_C$. A collector-emitter circuit of a transistor $Tr_1$ is connected across the capacitor $C_1$ through a constant current circuit $I_{C2}$, and the collector of the transistor $Tr_1$ is connected through the constant current circuit $I_{C2}$ to the power supply. The base-emitter of the transistor $Tr_1$ is supplied thereto a reference rectangular wave signal $P_0$ from a wave shaping circuit 28, and the transistor $Tr_1$ becomes conductive for a period of time during which the signal $P_0$ is generated. A detecting circuit 22 also includes a reset circuit RS comprising a semiconductor switch connected across the capacitor $C_1$, which is adapted to act at the trailing edge of the rectangular wave signal $P_0$ to allow the capacitor $C_1$ to instantly discharge. A voltage $V_C$ across the capacitor $C_1$ is supplied to a voltage comparator CP together with a reference voltage $V_r$ obtained from a reference voltage generator RG, and the output of the comparator CP is supplied to an AND circuit $A_1$ together with the rectangular wave signal $P_0$. Also, the output of the comparator CP is inverted by an inverter IN and then supplied to an AND circuit $A_2$ together with the rectangular wave signal $P_0$.

Figure 5:
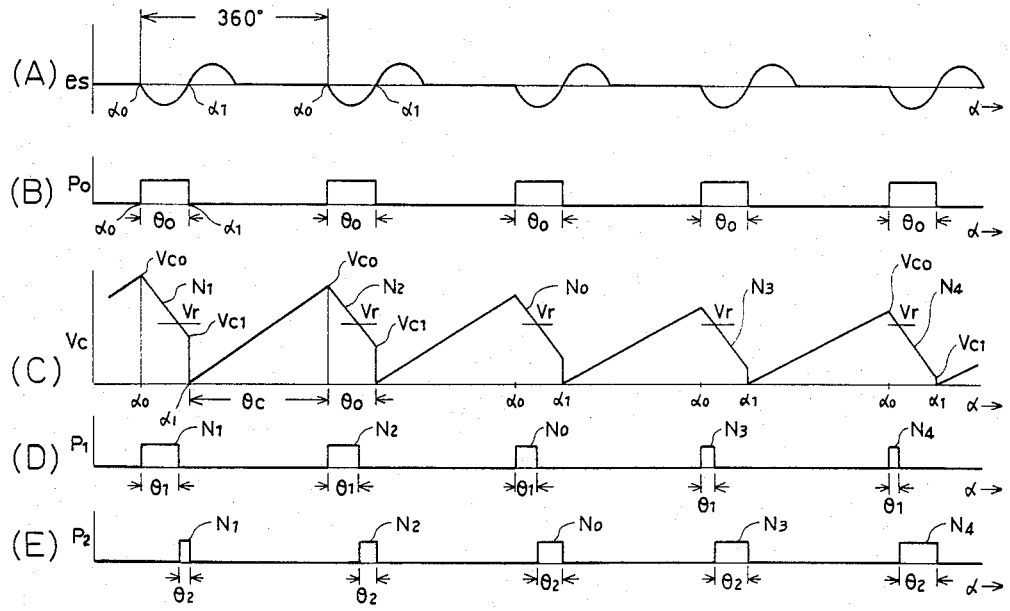
FIGS. 5A to 5E are signal wave form charts for explaining operation of the engine speed detecting circuit shown in FIG. 4.
Figure 6:
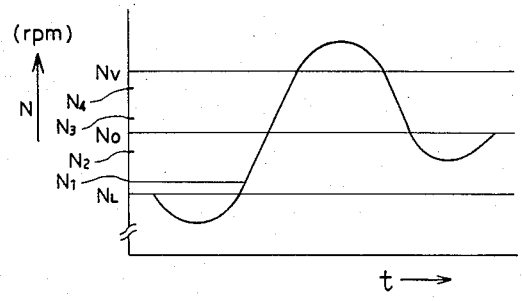
FIG. 6 is a diagrammatic view showing an example of the change of an engine speed with time.

In the circuit of FIG. 4 described above, when a signal generating coil 26 generates a signal $e_s$ as shown in FIG. 5A with respect to a rotation angle $\alpha$ of the engine at a constant angle position $\alpha_0$, the wave shaping circuit 28 generates the reference rectangular signal $P_0$ of an angular width of signal width $\theta_0$ as shown in FIG. 5B. The transistor $Tr_1$ is conductive for a period of time during which the rectangular wave signal $P_0$ is not generated, resulting in the capacitor $C_1$ being charged with a constant current through the constant current circuit $I_{C1}$ and the diode $D_1$. Thus, the voltage $V_C$ across the capacitor $C_1$ linearly rises with a constant gradient from the trailing edge of each rectangular wave signal $P_0$ to the leading edge of the next rectangular wave signal $P_0$. Whereas, the transistor $Tr_1$ is conductive for the period between $\alpha_0$ and $\alpha_1$ during which the rectangular wave signal $P_0$ is generated, to thereby allow the capacitor $C_1$ to discharge a constant current $i_2$ therefrom through the constant current circuit $I_{C2}$ and the transistor $Tr_1$. This results in the voltage $V_C$ across the capacitor $C_1$ dropping at a constant gradient during the period. The reset circuit RS operates at the trailing edge of the rectangular wave signal $P_0$ in such a manner to allow the capacitor $C_1$ to intantly discharge resulting in the voltage $V_C$ returning zero and then allow the voltage $V_C$ to rise at a constant gradient. The voltage comparator CP generates an output having a logical value of "1" for a period of time during which the voltage $V_C$ across the capacitor $C_1$ is larger than the reference $V_r$ and an output having a logical value of "0" for a period of time during which the voltage $V_C$ is below the reference voltage $V_r$. Therefore, the AND circuit $A_1$ generates first engine speed detection pulses $P_1$ each continuing for the time of $\theta_1$ during which the voltage $V_C$ is larger than the reference voltage $V_r$, in the range of the signal width $\theta_0$ of the rectangular wave signal $P_0$ as shown in FIG. 5D; and the AND circuit $A_2$ generates second engine speed detecting pulses $P_2$ each continuing for a time $\theta_2$ during which the voltage $V_C$ is smaller than the reference voltage $V_r$ within the signal width. Wave forms designated by characters $N_1$, $N_2$, $N_0$, $N_3$ and $N_4$ in FIGS. 5C to 5E respectively correspond to wave forms obtained at the respective engine speeds $N_1$, $N_2$, $N_0$, $N_3$ and $N_4$ in the case that the engine speed changes with respect to time as shown in FIG. 6. Time required to charge the capacitor $C_1$ is shortened with the increase in engine speed, therefore, the maximum value of the voltage $V_C$ decreases with the increase in engine speed. Thus, a phase at which the voltage $V_C$ coincides with the reference voltage $V_r$ advances with the increase of engine speed, so that the pulse width $\theta_1$ of the first engine speed detection pulse $P_1$ decreases with the increase of engine speed. On the contrary, the pulse width $\theta_2$ of the second engine speed detection pulse $P_2$ increases with the increase of engine speed. Further, the relationship $\theta_1+\theta_2=\theta_0$ is always satisfied; and, when the actual engine speed becomes equal to the set engine speed, the relationship $\theta_1=\theta_2=\theta_0/2$ is established. As described hereinafter, the engine speed which allows $\theta_1$ and $\theta_2$ to be equal to each other may be set by optionally changing the reference voltage $V_r$ and/or the charging current $i_1$ and discharge current $i_2$ as desired. Therefore, the engine speed setting circuit 32 shown in FIG. 1 or 3 may be formed by a circuit which is adapted to suitably adjust the voltage and currents as desired.

In the circuit of FIG. 4, when the capacitance of the capacitor $C_1$ and an angle at which the capacitor is charged (charging angle) are respectively indicated by C and $\theta_C$ $(=360°-\theta_C)$, the pulse widths $\theta_1$ and $\theta_2$ will be given by the following equations (1) and (2).

$$\theta_1=(i_1/i_2)\theta_C-\{(6CV_r)/i_2\}N \quad (1)$$

$$\theta_2=\{\theta_0-(i_1/i_2)\theta_C\}+\{(6CV_r)/i_2\}N \quad (2)$$

Further, when the pulse widths $\theta_1$ and $\theta_2$ are converted into the time widths $T_1$ and $T_2$, $T_1$ and $T_2$ will be given by the following equations (3) and (4).

$$T_1=(i_1/i_2)(\theta_C/6N)-(C/i_2)V_r \quad (3)$$

$$T_2=\{\theta_0-(i_1/i_2)\theta_C\}(1/6N)+(CV_r)/i_2 \quad (4)$$

From these equations, it will be noted that the angular width and time width of each of the first and second engine speed detection pulses $P_1$ and $P_2$ are functions of the engine speed N and provide data on the engine speed.

First and second engine speed data signals $n_1$ and $n_2$ of clock pulses respectively having a frequency $f_1$ in the time widths $T_1$ and $T_2$ will be given by the following equations (5) and (6).

$$n_1=(f_1\cdot i_1\cdot\theta_C)/(6Ni_2)-(f_1\cdot V_rC)/i_2 \quad (5)$$

$$n_2=\{\theta_0-(i_1/i_2)\theta_C\}\cdot f_1/(6N)+(f_1\cdot V_rC)/i_2 \quad (6)$$

The difference or deviation signal $n_d$ between $n_1$ and $n_2$ will be given by the following equation (7).

$$n_d = n_1 - n_2$$
$$= (1/N)f_1\{(i_1 \cdot \theta_C)/(3i_2) - \theta_0/6\} - (2f_1 \cdot C \cdot V_r)/i_2 \quad (7)$$

In this case, it is required that the conditions $(i_1 \cdot \theta_C)/(3i_2) - \theta_0/6 > 0$ and $V_r > 0$ are satisfied, and the voltage $V_C$ must be positive at the trailing edge of the rectangular wave signal $P_0$. In other words, a relationship indicated by the following equation (8 ) must be established between the time width $T_0$ of the rectangular wave signal $P_0$ and the charging time $T_C$ of the capacitor.

$$(i_1/C)T_C > (i_2/C)T_0 \quad (8)$$

From the equation (8), the following equation (9) will be obtained.

$$i_1/i_2 > \theta_0/\theta_C \quad (9)$$

$n_d$ is zero at the set engine speed $N_0$, thus, $N_0$ will be given by the following equation (10).

$$N_0 = f_1 \cdot \{(i_1 \cdot \theta_C)/(3i_2) - \theta_0/6\} \cdot i_2/(2f_1 \cdot CV_r)$$
$$= (2i_1 \cdot \theta_C - \theta_0 \cdot i_2)/(12C \cdot V_r) \quad (10)$$

Figure 7:
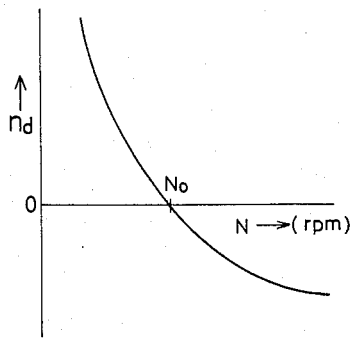
FIG. 7 is a diagrammatic view showing an example of the change of a deviation signal with an engine speed.

Under the above-mentioned conditions, the equation (7) is as shown in FIG. 7. More particularly, $n_d$ is zero when the actual engine speed N is equal to the set engine speed $N_0$ and increases with deviation of N from $N_0$. This indicates that $n_d$ contains not only data on the deviation signal but data on the actual engine speed. Further, it will be noted from the equation (10) that the set engine speed $N_0$ may be optionally determined on the basis of the charging and discharge currents $i_1$ and $i_2$ and the reference voltage $V_r$ as desired.

In the equation (7), $n_d$ is positive when N is smaller than $N_0$ and negative when N is larger than $N_0$. The discrimination on the sign (positive or negative) of $n_d$ may be carried out according to any one of various digital procedures. One exemplary digital procedure is to carry out an Analog-Digital conversion using a counter, which is adapted to invert the output of a Flip-Flop circuit when value counted by the counter is zero and discriminate the sign of $n_d$ based on the state of output of the Flip-Flop circuit.

Now, the following description will be made on the case of counting the number of clock pulses having the frequency $f_1$ within the time width of the reference rectangular wave signal $P_0$ to obtain an engine speed detecting signal, without making the first and second engine speed detection pulses $P_1$ and $P_2$. The counted value or number of clock pulses $n_x$ will be given by the following equation (11).

$$n_x = (\theta_0/6N)f_1 \quad (11)$$

The counted value or number of clock pulses $n_0$ at the set engine speed $N_0$ will be given by the following equation (12).

$$n_0 = (\theta_0/6N_0)f \quad (12)$$

A deviation signal $n_d'$ is obtained by taking the difference between $n_x$ and $n_0$, as follows.

$$n_d' = n_x - n_0 = (\theta_0 \cdot f_1)/(6N) - (\theta_0 \cdot f_1)/(6N_0) \quad (13).$$

The comparison in discrimination between the detection of engine speed using $n_d$ obtained by the equation (7) and the detection of engine speed using $n_d'$ obtained by the equation (13) is carried out by comparing the number of pulses allocated per unit engine speed in the former with that in the latter or comparing $f_1\{i_1 \cdot \theta_C)/(3i_2) - \theta_0/6\}$ which is a coefficient of (1/N) in the equation (7) with $\theta_0 \cdot f_1/6$ which is a coefficient of (1/N) in the equation (13). The difference between the both coefficients will be indicated by the following equation (14).

$$f_1\{(i_1 \cdot \theta_C)/(3i_2) - \theta_0/6\} - (\theta_0 f_1)/6 = (f_1/3)\{(i_1 \cdot \theta_0)/i_2 - \theta_0\} \quad (14).$$

The conditions given by the equation (9) allow the right side of the equation (14) to be positive, thus, it will be noted that the procedure utilizing the difference in time width between the first and second engine speed detection pulses $P_1$ and $P_2$ is superior in discrimination.

The following description will be made on establishment of the derivative control engine speed range in the embodiments described above. In FIG. 5, the voltage $V_C$ across the capacitor $C_1$ has data on the engine speed contained in the three places, namely, the discharge starting position $\alpha_0$, the reset position $\alpha_1$ and the discharge range between $\alpha_0$ and $\alpha_1$. The embodiments described above utilizes data contained in the discharge range as the engine speed deviation signal $n_d$ of the equation (7). Whereas, the deviation control engine speed range is set utilizing data on the engine speed contained in the discharge starting position $\alpha_0$ and the reset position $\alpha_1$; and the upper limit of the deviaton control engine speed range is determined by an engine speed $N_V$ at which the charged voltage $V_{CO}$ of the capacitor at the discharge starting position $\alpha_0$ is equal to the reference voltage $V_r$ and the lower limit thereof is determined by an engine speed $N_L$ at which the voltage $V_{C1}$ across the capacitor just before reset is equal to the reference voltage $V_r$.

The charged voltage $V_{C0}$ of the capacitor at the angle $\alpha_0$ will be given by the following equation (16).

$$V_{C0} = (i_1/C)\,(\theta_C/6N) \quad (16)$$

In the equation (16), supposing that $V_{C0}$ and N are respectively equal to $V_r$ and $N_V$, the following equation (17) will be obtained.

$$N_V = (i_1 \cdot \theta_C)/(6C \cdot V_r) \quad (17)$$

The upper limit engine speed $N_V$ corresponds to an engine speed at which the time width of the first engine speed detection pulse $P_1$ is zero. Thus, $N_V$ may be actually obtained by detecting a position at which $n_1$ is zero.

Next, the voltage $V_{C1}$ across the capacitor just before reset at the angle $\alpha_1$ will be given by the following equation (18).

$$V_{C1} = (i_1/C)(\theta_C/6N) - (i_2/C)(\theta_0/6N) \quad (18)$$

In the equation (18), supposing that $V_{C1}$ and N are respectively equal to $V_r$ and $N_L$, the following equation (19) will be obtained.

$$N_L = (i_1 \cdot \theta_C - i_2 \cdot \theta_0)/(6 \cdot C \cdot V_r) \quad (19)$$

The lower limit engine speed $N_L$ corresponds to an engine speed at which the time width of the second engine speed detection pulse $P_2$ is zero. Accordingly, $N_L$ may be actually obtained by detecting a position at which $n_2$ is zero.

As described above, the procedure of generating the two engine speed detection pulses $P_1$ and $P_2$ which change in the direction opposite to each other with the change of engine speed while the pulse widths $\theta_1$ and $\theta_2$ keep the relationship $\theta_1+\theta_2=\eta_0$ with respect to the signal width $\theta_0$ of the reference rectangular wave signal $P_0$ and obtaining data on the engine speed based on the difference in time width between the both pulses allows discrimination to be significantly improved when data on the engine speed is processed according to a digital procedure, to thereby accomplish the control of engine speed with high accuracy. Such engine speed detecting method of the present invention is readily applicable to other rotational speed controlling systems as well as an engine speed controlling system. Also, the method is applied to the measurement of engine speed to allow the measurement to be carried out with high accuracy.

The process of generating the first and second engine speed detection pulses $P_1$ and $P_2$ in the present invention is not limited to the embodiments described above. For example, the substantially same pulses can be obtained also when the charging and discharge current of the capacitor are not constant in the engine speed detecting circuit illustrated in FIG. 4. Also, two pulses of which the pulse widths change in the directions opposite to each other with the change of engine speed can be obtained also by applying the voltage across the capacitor which begins charge at the leading edge $\alpha_0$ of the rectangular wave signal $P_0$ and is reset at the trailing edge $\alpha_1$ thereof to the comparator CP in the circuit of FIG. 4.

The control method of the present invention is preferably practiced using the engine speed detecting procedure described above. However, the present control method may be practiced using other suitable detecting procedures. For example, the engine speed may be detected by converting the time width of the rectangular wave signal $P_0$ into a digital quantity.

Furthermore, the derivative control engine speed range may be set according to any suitable procedure other than in the embodiments described above.

As can be seen from the foregoing, the engine speed controlling method of the present invention is capable of significantly improving transient response characteristics because the derivative control action is carried out only in the specific engine speed range about the set engine speed. Also, the engine speed control apparatus of the present invention is capable of effectively improving transient response characteristics and controlling the engine speed with high accuracy.

As many apparently widely different embodiments of this invention may be made without departing from the spirit and scope thereof, it is to be understood that the invention is not limited to the specific embodiment thereof except as defined in the appended claims.

What is claimed is:

1. A method of controlling an engine speed for an internal combustion engine by controlling an engine speed adjusting operation unit which controls to keep the engine speed of the internal combustion engine at a set engine speed based on proportional control and derivative control action, comprising the steps of:

generating a reference signal $P_0$ of a reference signal width $\theta_0$ at a predetermined rotational angle position of the engine;

generating a first engine speed detection pulse $P_1$ having a first pulse width $\theta_1$ which is narrower than that of said reference signal and varied depending upon the actual engine speed and a second engine speed detection pulse $P_2$ having a second pulse width $\theta_2$ which is equal to the difference between said signal width $\theta_0$ of said reference signal $P_0$ and said first pulse width $\theta_1$;

obtaining the difference between the time width $T_1$ of said first engine speed detection pulse $P_1$ and the time width $T_2$ of said second engine speed detection pulse $P_2$ to thereby generate an engine speed deviation signal which indicates the deviation between the actual engine speed and said set engine speed;

generating an engine speed derivative signal which indicates the rate of change of said deviation signal or an actual engine speed signal obtained on the basis of said time width $T_1$ of said first engine speed detection pulse $P_1$ with respect to time;

deteriming the range between an engine speed at which said first pulse width $\theta_1$ is rendered zero and an engine speed at which said second pulse width $\theta_2$ is rendered zero to be a derivative control engine speed range;

generating a first manipulated variable command signal which determines a manipulated variable of an engine speed adjusting operation unit of said internal combustion engine depending upon said engine speed deviation signal;

generating a second manipulated variable command signal which determines a manipulated variable of said engine speed adjusting operation unit depending upon said engine speed derivative signal; and operating said engine speed adjusting operation unit based upon said first manipulated variable command signal to allow only the proportional control action to be carried out when said actual engine speed of the engine is out of said derivative control engine speed range, and operating said engine speed adjusting operation unit based upon both of said first and second manipulated variable command signals to allow the proportional control action and derivative control action to be carried out when said actual engine speed is within derivative control engine speed range.

2. An apparatus for controlling an engine speed for an internal combustion engine which controls to keep the engine speed of the internal combustion engine at a set engine speed based on proportional control action and derivative control action, comprising:

an engine speed detecting circuit for detecting the actual engine speed of the engine, said engine speed detecting circuit comprising a reference signal generating circuit which generates a reference rectangular wave signal $P_0$ of a constant signal width $\theta_0$ for detecting the engine speed at a fixed rotation angle position of said engine and an engine speed detection pulse generating circuit for generating a first engine speed detection pulse $p_1$ having a first pulse width $\theta_1$ which is narrower than the signal width $\theta_1$ of said reference rectangular wave signal $P_0$ and changes depending upon the change of said actual engine speed and a second engine speed detection pulse $P_2$ having a second pulse width $\theta_2$ which is equal to the difference between said signal width $\theta_0$ of said reference rectangular wave signal $P_0$ and said first pulse width $\theta_1$;

a deviation signal generating circuit for generating an engine speed deviation signal indicating deviation of said actual engine speed from said set engine speed, said deviation signal generating circuit comprising a circuit which takes the difference between a first engine speed data signal $n_1$ obtained by converting the time width $T_1$ of said first engine speed detection pulse $P_1$ into a digital quantity and a second engine speed data signal $n_2$ obtained by converting the time width $T_2$ of said second engine speed detection pulse $P_2$ into a digital quantity;

a derivative signal generating circuit for generating an engine speed derivative signal indicating the rate of change of said deviation signal or actual engine speed signal with respect to time, said derivative signal generating circuit comprising a memory circuit which stores therein, as an engine speed detecting signal n, a differential signal between said first engine speed data signal $n_1$ and said second engine speed data signal $n_2$ or a digital signal obtained by converting the time width of said first engine speed detection pulse $P_1$ into a digital quantity and a variation detecting circuit which takes the difference between an engine speed detecting signal n' previously stored in said memory circuit and a newly generated engine speed detecting signal n;

a first manipulated variable command signal generating circuit for generating a first manipulated variable command signal which determines a manipulated variable of an engine speed adjusting operation unit within said internal combustion engine depending upon said engine speed deviation signal;

a second manipulated variable command signal generating circuit for generating a second manipulated variable command signal which determines a manipulated variable of said operation unit depending upon said engine speed derivative signal;

an operation signal generating circuit for generating an operation signal necessary to operate said operation unit based on said first and second manipulated variable command signals; and a derivative action stopping control circuit which acts to set a derivative control engine speed range about said set engine speed and render said second manipulated variable command signal generated from said second manipulated variable command signal generating circuit zero when said actual engine speed is out of said derivative control engine speed range, said derivative action stopping control circuit acting to set, as said derivative control engine speed range, a range between an engine speed at which said first pulse width $\theta_1$ of said first engine speed detection pulse $P_1$ is rendered zero and an engine speed at which the second pulse width $\theta_2$ of said second engine speed detection pulse $P_2$ is rendered zero.

3. An apparatus for controlling an engine speed as defined in claim 2, wherein said reference signal generating circuit provided in said engine speed detecting circuit comprises a signal generating coil which generates a signal voltage of a constant angular width at a fixed rotation angle position of said engine and a wave shaping circuit which shapes the wave of said signal voltage to generate a reference rectangular wave signal $P_0$ of a constant signal width $\theta_0$ for detecting the engine speed.

4. An apparatus for controlling an engine speed as defined in claim 2, wherein said engine speed detection pulse generating circuit provided in said engine speed detecting circuit comprises a capacitor which is charged by a constant current until said reference rectangular wave signal $P_0$ is generated and discharged in such a manner that a discharge voltage $V_C$ is decreased with a constant gradient while said reference rectangular wave signal $P_0$ is generated, a comparator which generates an output signal having a logical value of "1" while the discharge voltage $V_C$ of said capacitor is larger than said reference voltage and an output signal having a logical value of "0" when said voltage $V_C$ is below said reference voltage, and a reset circuit which decreases said discharge voltage to zero at the trailing edge of said reference rectangular wave signal $P_0$; said first engine speed detection pulse $P_1$ being generated for a period of time during which said comparator generates said signal having a logical value of "1" and said second engine speed detection pulse $P_2$ being generated for a period of time during which said comparator generates said signal having a logical value of "0".

5. An apparatus for controlling an engine speed as defined in claim 2, wherein said first and second pulse widths $\theta_1$ and $\theta_2$ and said signal width $\theta_0$ of said reference rectangular wave signal $P_0$ always satisfy a relationship $\theta_1+\theta_2=\theta_0$ therebetween.

6. An apparatus for controlling an engine speed as defined in claim 2, wherein said variation detecting circuit provided in said derivative signal generating circuit comprises a subtracter circuit.

7. An apparatus for controlling an engine speed as defined in claim 2, wherein the time width $T_1$ of said engine speed detection pulse $P_1$ and the time width $T_2$ of said engine speed detection pulse $P_2$ are converted into said first and second engine speed data signals $n_1$ and $n_2$, respectively by and Analog-Digital converter.

8. An apparatus for controlling an engine speed as defined in claim 2 further comprising an idle running control circuit which generates a deviation signal $n_i$ indicating deviation of said deviation signal generated from said deviation signal generating circuit from an idling speed command signal indicating an idling engine speed; said deviation signal $n_i$ being supplied to said first manipulated variable command signal generating circuit in order to determine a manipulated variable of said operation unit necessary to carry out the idle running of said engine.

9. An apparatus for controlling an engine speed as defined in claim 2, said operation signal generating circuit comprises an adder circuit.

10. An apparatus for controlling an engine speed as defined in claim 9, wherein said operation signal is made by adding said first and second manipulated variables to each other in said adder circuit.

* * * * *